US007322742B2

(12) United States Patent
Goeller

(10) Patent No.: US 7,322,742 B2
(45) Date of Patent: Jan. 29, 2008

(54) TIMEPIECE WITH A STRIKING MECHANISM COMPRISING A SINGLE BARREL

(75) Inventor: Eric Goeller, Les Hôpitaux Vieux (FR)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 11/733,884

(22) Filed: Apr. 11, 2007

(65) Prior Publication Data

US 2007/0242568 A1 Oct. 18, 2007

(51) Int. Cl.
*G04B 25/00* (2006.01)
*G04B 3/00* (2006.01)
*G04B 23/02* (2006.01)

(52) U.S. Cl. ..... 368/147; 368/206; 368/244; 368/260

(58) Field of Classification Search ..... 368/98–100, 368/145, 147, 243, 244, 260, 264
See application file for complete search history.

(56) References Cited

U.S. PATENT DOCUMENTS

| | | | | |
|---|---|---|---|---|
| 621,002 A | | 3/1899 | Washau | |
| 1,891,281 A | * | 12/1932 | Johnson | 368/244 |
| 2,074,025 A | * | 3/1937 | Porter | 368/260 |
| 2,538,161 A | * | 1/1951 | Morganson | 368/260 |
| 2,799,334 A | * | 7/1957 | Schwab | 368/246 |
| 3,020,702 A | * | 2/1962 | Feldman | 368/88 |
| 3,316,707 A | * | 5/1967 | Schneider | 368/248 |
| 3,349,555 A | * | 10/1967 | Bridevaux | 368/244 |
| 3,440,816 A | * | 4/1969 | Jaccard | 368/248 |
| 3,462,943 A | * | 8/1969 | Micheloud et al. | 368/244 |
| 7,021,819 B2 | * | 4/2006 | Schmiedchen | 368/147 |
| 7,192,181 B2 | * | 3/2007 | Schmiedchen | 368/140 |

FOREIGN PATENT DOCUMENTS

| | | |
|---|---|---|
| CH | 23477 | 3/1901 |
| CH | 50729 | 3/1910 |

OTHER PUBLICATIONS

European Search Report issued in corresponding application No. EP 06112532 completed Feb. 8, 2007.
"Les Montres Compliquees," Chapter entitled "Grande sonnerie" through p. 205.

* cited by examiner

*Primary Examiner*—Vit W Miska
(74) *Attorney, Agent, or Firm*—Griffin & Szipl, P.C.

(57) ABSTRACT

The invention proposes a timepiece including a motion work (12) which drives analogue display means (14) and a strike train (16) which drives a striking mechanism (18), wherein the motion work (12) is driven in rotation by a barrel (20) including a spring, a toothing which meshes with the motion work (12), and a winding ratchet (38) coaxial to the barrel (20), the winding ratchet (38) being secured in rotation to the drive arbour (26) of the barrel (20), and wherein a winding member (44) is provided to mesh with the winding ratchet (38) in order to wind the barrel spring (24), characterized in that the winding ratchet (38) drives the strike train (16) in rotation via an intermediate wheel set (45) whose axis (A2) is shifted relative to the axis (A1) of the barrel (20), and in that the intermediate wheel set (45) includes a click device (47) for uncoupling the winding ratchet (38) relative to the strike train (16) during the winding phase of the spring (24).

7 Claims, 4 Drawing Sheets

TIMEPIECE WITH A STRIKING MECHANISM COMPRISING A SINGLE BARREL

This application claims priority from European Patent Application No. 06112532.4, filed Apr. 12, 2006, the entire disclosure of which is incorporated herein by reference.

FIELD OF THE INVENTION

The invention concerns a timepiece comprising a repeater striking mechanism, particularly a grand strike wristwatch.

The invention concerns more specifically a timepiece comprising a motion work which drives the analogue display means and a strike train which drives a striking mechanism, wherein the motion work is driven in rotation by a barrel comprising a barrel spring, a toothing that meshes with the motion work, and a winding ratchet coaxial to the barrel, the winding ratchet being rotatively coupled to the driving arbour of the barrel, and wherein a winding member is provided for meshing with the winding ratchet in order to wind the barrel spring during a winding phase.

BACKGROUND OF THE INVENTION

Such timepieces have been known for a long time, in particular within the domain of so-called complicated watches such as repeater watches or grand strike watches. For a good understanding of the state of the art within the domain of complicated watches, reference can be made to the work by Francois Lecoultre entitled "Les montres compliquées" (ISBN 2-88175-000-1), which includes in particular several chapters relating to watches fitted with a striking mechanism (pages 97 to 205), including one chapter dedicated to grand strike watches (182 to 205).

Grand strike watches generally comprise two gear trains, a motion work for driving the time display means such as hands, and a strike train for driving the striking mechanism, each train comprising its own barrel and barrel spring to provide the drive energy for driving the train.

In order to reduce the number of elements forming the timepiece and in order to save space, the use of a single barrel for both trains has been proposed. This is the case in CH Patent Nos. 50 729 and 23 477, which each disclose and show a timepiece wherein the motion work is driven by the toothed drum of the barrel and the strike train is driven by a toothed wheel coaxial to the barrel arbour and connected in rotation to the barrel arbour by a click cooperating via a ratchet secured to the barrel arbour.

These solutions are not completely satisfactory since they require an alteration to the barrel structure in order to make it able to withstand this dual use. In particular, an additional click and ratchet system has to be arranged on the top face of the barrel, whereas the winding ratchet has to be arranged on the opposite side, which has a negative effect on the axial space requirement of the barrel.

SUMMARY OF THE INVENTION

It is an object of the present invention to overcome these drawbacks by proposing an alternative solution for making a drive mechanism with a single barrel that minimises the axial space requirement and facilitates assembly operations.

It is also an object of the present invention to propose a solution that uses a standard barrel.

With this object, the invention proposes a timepiece of the type previously described, characterized in that the winding ratchet drives the strike train in rotation via an intermediate wheel set whose axis is shifted relative to the axis of the barrel, and in that the intermediate wheel set comprises a click device for uncoupling the winding ratchet relative to the strike train during the spring winding phase.

Owing to the timepiece according to the invention, it is possible to use a standard barrel for driving both the motion work and the strike train, which limits the number of different references for making, for example, a timepiece model with a striking mechanism and a model without a striking mechanism.

Since the barrel structure is not altered, its axial space requirement is not altered, which facilitates the arrangement of the barrel in the timepiece.

According to an advantageous embodiment, the intermediate wheel set comprises an intermediate wheel which is driven in rotation by the winding ratchet, and ratchet wheel which is connected to the intermediate wheel in rotation, and an intermediate pinion which is connected in rotation to the ratchet wheel by at least one click and which meshes with the strike train. The intermediate wheel set according to the invention thus has a particularly simple structure and is compact, which facilitates the arrangement thereof in the timepiece.

Preferably, the intermediate wheel extends in the same plane as the winding ratchet which minimises the axial space requirement of the intermediate wheel set.

The ratchet wheel includes an axial extension and the intermediate wheel is fixedly secured to this axial extension in rotation. A drive system that is particularly compact, especially axially, is thus obtained for transmitting the couple from the winding ratchet to the strike train.

Advantageously, the ratchet wheel comprises at least two clicks, and the intermediate pinion is provided with a coaxial inversion wheel, which is connected in rotation to the intermediate pinion with a determined angular clearance and which comprises means for controlling the raising of the clicks when the inversion wheel is made to move angularly relative to the intermediate pinion. This facilitates maintenance operations by controlling the raising of all the clicks with a single tool in order to let down the barrel spring, particularly when one wishes to work on the striking mechanism.

According to an advantageous embodiment, an auxiliary setting wheel meshes with the intermediate pinion, and the auxiliary setting wheel is drawn in rotation in the direction that the strike train is driven, so as to maintain a locking torque on the intermediate pinion during the winding phase. This thus limits the risk of the striking mechanism being inadvertently released during the winding phases.

Advantageously, the winding ratchet meshes with a main setting wheel which meshes with the intermediate wheel set. Adequate reduction is thus obtained while minimising the space requirement of the drive elements connecting the winding ratchet to the strike train.

BRIEF DESCRIPTION OF THE DRAWINGS

Other features and advantages of the present invention will appear more clearly upon reading the following detailed description, made with reference to the annexed drawings, given by way of non-limiting example and in which.

DETAILED DESCRIPTION OF THE ILLUSTRATIVE EMBODIMENTS

In the annexed Figures, when trains are shown, the teeth of the trains are not systematically shown, in order to simplify the drawings and facilitate comprehension of the drawings.

Figure 1:
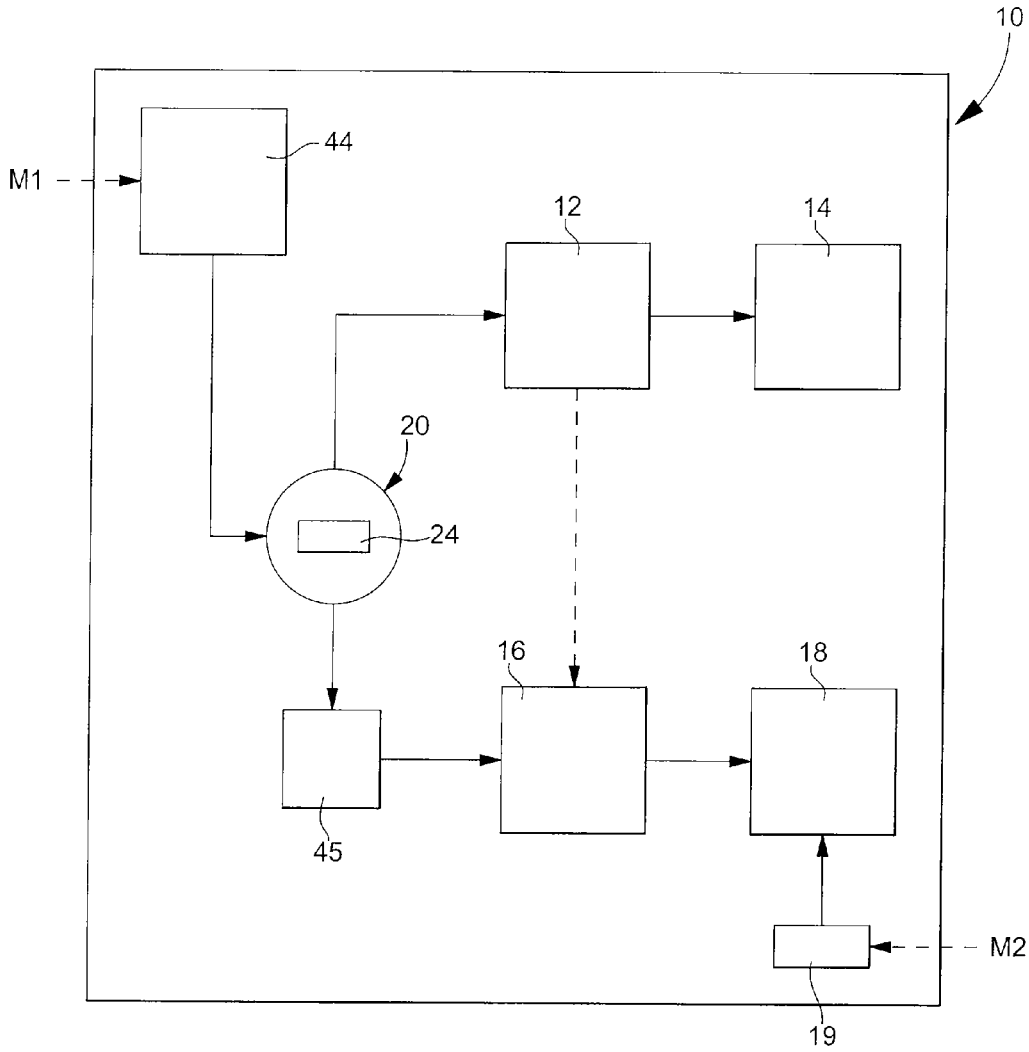
FIG. 1 is a block diagram which shows the main elements of the timepiece according to the invention.

FIG. 1 shows a timepiece 10 made in accordance with the teaching of the invention in the form of a block diagram. Timepiece 10 is preferably formed by a wristwatch 10 fitted with a mechanical watch movement which is provided with a motion work 12 cooperating with analogue display means 14, such as hands, for displaying the current time and which is provided with a strike train 16 cooperating with a repeater striking mechanism 18 for indicating at least the current time by hammers striking gongs (not shown).

The repeater striking mechanism 18 of wristwatch 10 according to the invention is for example of the grand strike type, i.e. it is capable of striking the hours and the quarters, and it is either released automatically or upon demand, via the effect of manual intervention M2. FIG. 1 shows schematically a member 19 for releasing the striking mechanism, formed for example by a release lever.

Figure 2:
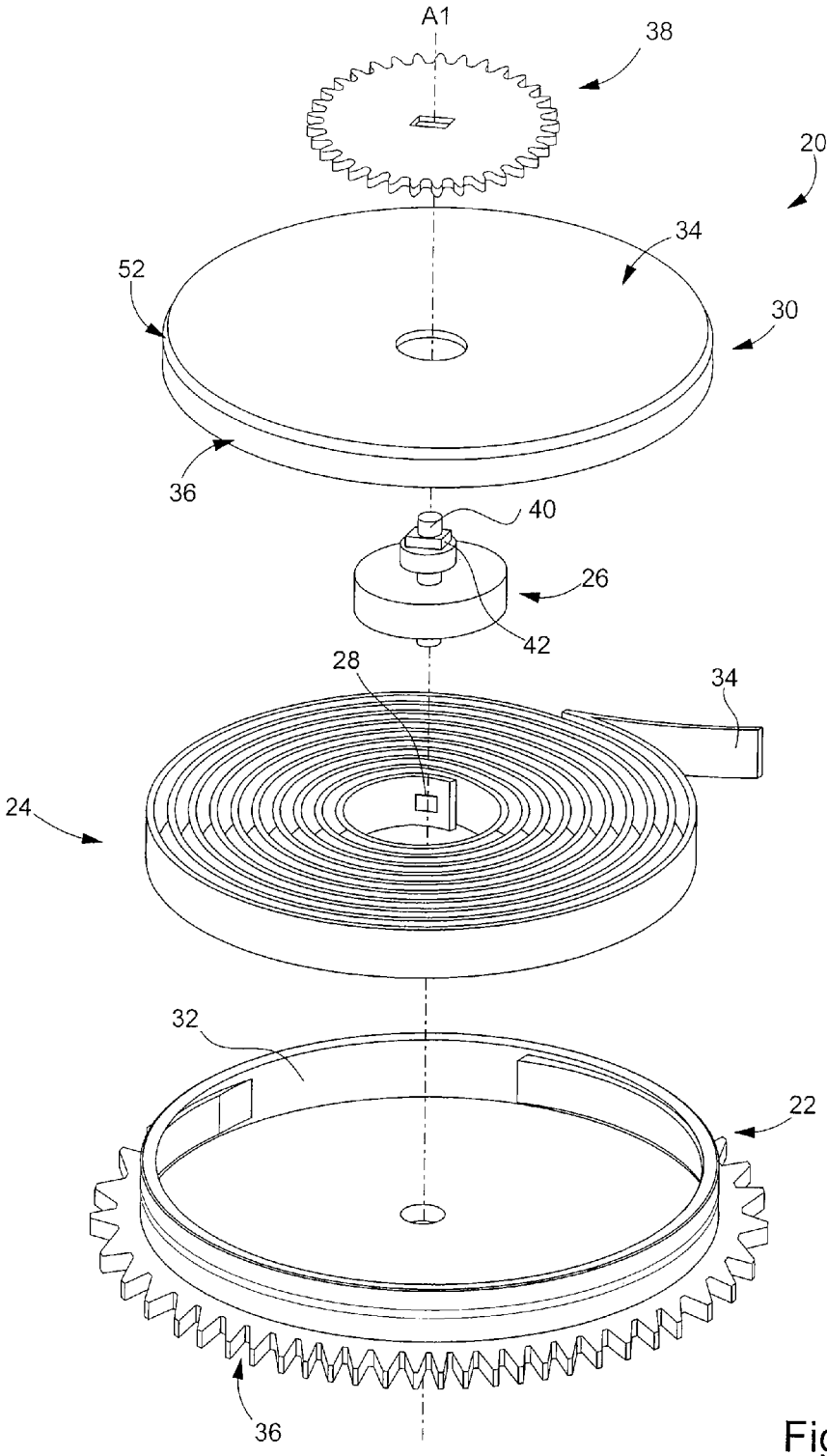
FIG. 2 is an exploded perspective view which shows schematically the main elements of the barrel of the timepiece of FIG. 1.
Figure 3:
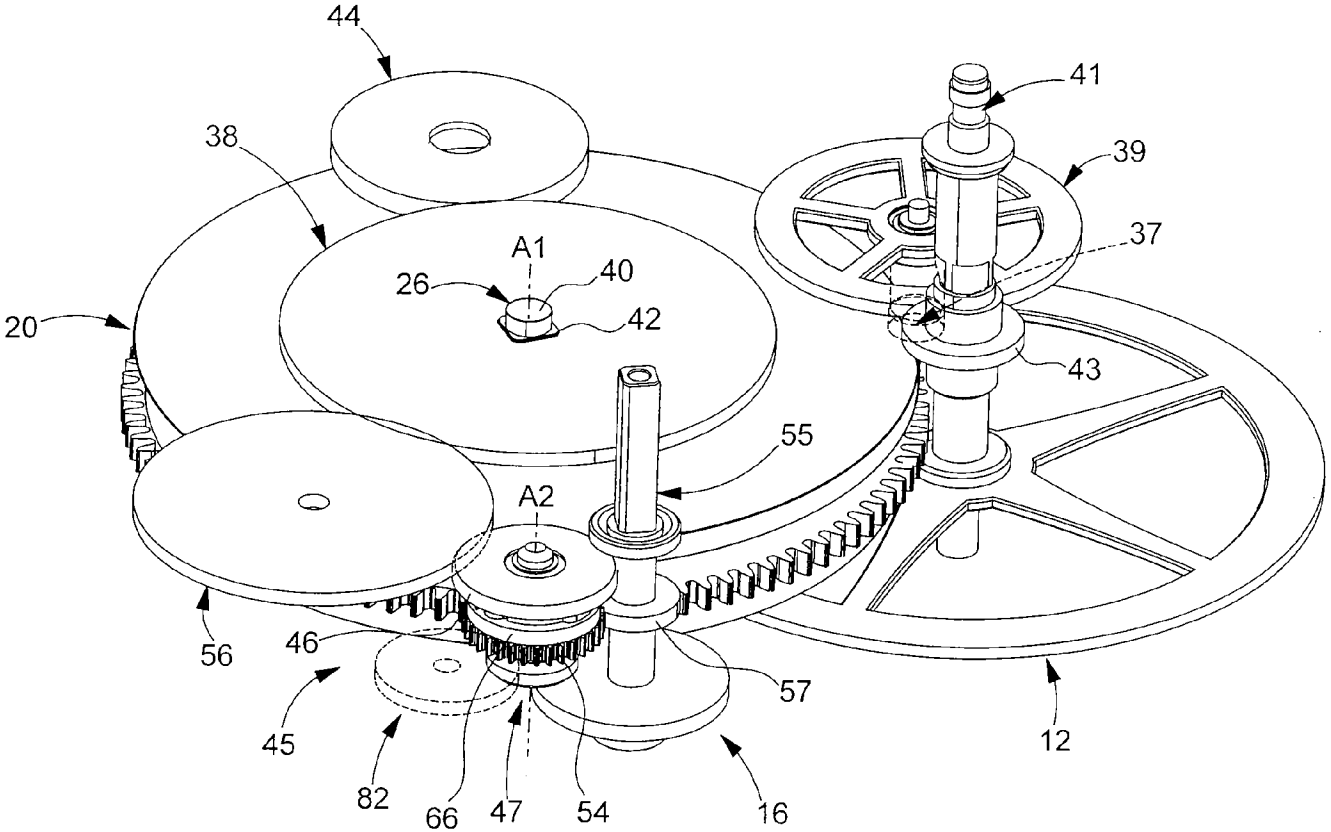
FIG. 3 is a perspective view which shows schematically the barrel and one part of the train elements of the timepiece of FIG. 1.

Motion work 12 is driven in rotation by a barrel 20, which is shown in FIGS. 2 and 3, comprising a cylindrical drum 22 which houses a barrel spring 24, a drive arbour 26, to which a first end 28 of spring 24 is secured, and a cover 30 which closes drum 22 at its top axial end.

In the following description, a vertical orientation along axis A1 of drive arbour 26 of barrel 20 will be used in a non-limiting manner.

Spring 24 is a strip in the shape of a coil wound around drive arbour 26. Drum 22 includes a recess 32 in its inner axial wall for securing a second end 34 of spring 24.

Drum 22 comprises an external toothing 36 which meshes with an intermediate motion work pinion 37 secured in rotation with intermediate motion work wheel 39 (visible in FIG. 3) of motion work 12, so as to transmit the torque supplied by spring 24 to motion work 12. The motion work axis of centre 41 is shown, provided with a pinion 43 meshing with the motion work intermediate wheel 39.

A winding ratchet 38 coaxial to barrel 20 is mounted on the top axial end 40 of drive arbour 26 via a square 42, so that winding ratchet 38 is secured to drive arbour 26 in rotation.

A winding member 44, which can be controlled by a manual action M1 on a winding stem (not shown), is provided for winding barrel spring 24, during a winding phase. Winding member 44 is formed here by a pinion that meshes with winding ratchet 38 so as to drive winding ratchet 38 in rotation in the winding direction of spring 24, in the clockwise direction in FIG. 3.

According to the teaching of the invention, winding ratchet 38 drives strike train 16 in rotation via an intermediate wheel set 45 whose axis of rotation A2 is shifted relative to the axis A1 of barrel 20. Intermediate wheel set 45 is provided with a click device 47 for uncoupling winding ratchet 38 relative to strike train 16 during the winding phase of spring 24.

Intermediate wheel set 45 comprises an intermediate wheel 46, which is connected in rotation to ratchet wheel 48. Ratchet wheel 48 is connected in rotation, in the let down direction of barrel spring 24, via two clicks 50, 52, to an intermediate pinion 54 meshing with strike train 16. Click device 47 is formed here by ratchet wheel 48, clicks 50, 52 and intermediate pinion 54.

FIG. 3 shows the centre striking arbour 55 which is provided with a pinion 57 meshing with intermediate pinion 54.

When release member 19 is activated, whether automatically or by a manual intervention M2, it releases strike train 16, which is driven in rotation via the effect of barrel spring 24 letting down, spring 24 then unwinding in the direction of let down causing winding ratchet 38 to rotate, here in the anti-clockwise direction. Winding ratchet 38 is thus retained in the direction of let down of barrel spring 24 by strike train 16, which remains locked until it has been released by release member 19.

According to the embodiment shown here, winding ratchet 38 meshes with a main setting wheel 56, which meshes with intermediate wheel 46. Main setting wheel 56 and intermediate wheel 46 extend in the same plane as winding ratchet 38.

Figure 4:
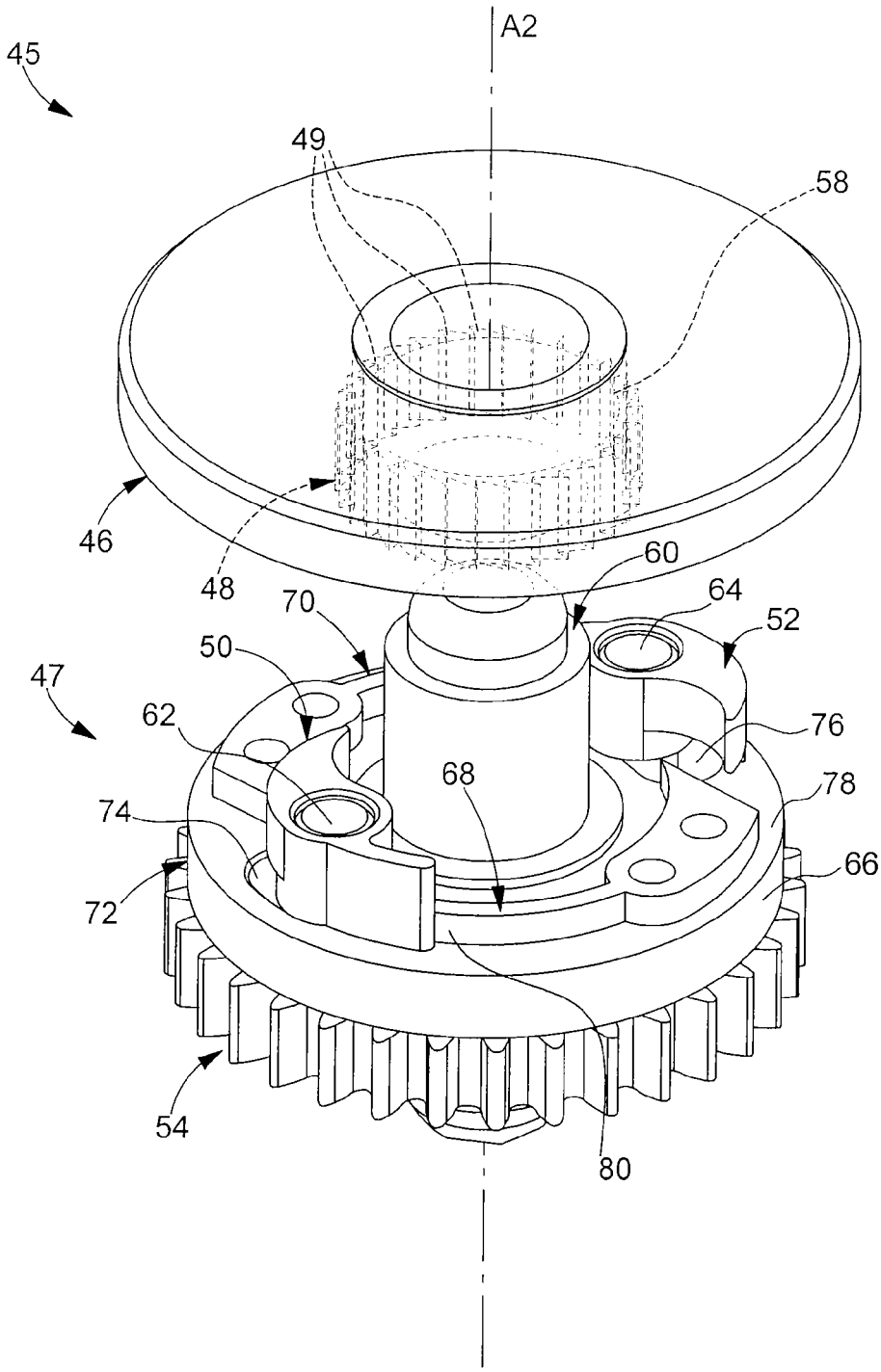
FIG. 4 is a perspective view which shows schematically the intermediate wheel set fitted to the timepiece of FIG. 1.

According to an advantageous embodiment, illustrated in particular in FIG. 4, ratchet wheel 48 is annular and comprises, towards the top, a tubular axial extension 58. Intermediate wheel is driven into this extension 58 so that ratchet wheel 48 is coaxial to and received in rotation with intermediate wheel 46. Intermediate pinion 54 is made here in a single piece with its arbour of rotation 60 which extends axially inside ratchet wheel 48 and axial extension 58. Arbour 60 of intermediate pinion 54 is mounted so as to rotate freely relative to ratchet wheel 48. Ratchet wheel 48 and intermediate wheel 46 are carried by intermediate pinion 54.

Each click 50, 52 is pivotably mounted about a click arbour 62, 64, which is secured in the top transverse face 66 of intermediate pinion 54. The two click arbours 62, 64 are diametrically opposite here. Each click 50, 52 is drawn towards the teeth of ratchet wheel 48 by an associated resilient return strip 68, 70.

Advantageously, an inversion wheel 72 is inserted axially between ratchet wheel 48 and intermediate pinion 54. Inversion wheel 72 comprises two oblong holes 74, 76 through which the two click arbours 62, 64 respectively extend. Resilient strips 68, 70 are fixed here to the top transverse face 78 of inversion wheel 72.

Inversion wheel 72 is connected in rotation to intermediate pinion 54 by the abutment of click arbours 62, 64 against the end edge of the associate hole 74, 76. Holes 74, 76 allow a determined angular clearance via the circumferential length of holes 74, 76, between inversion wheel 72 and intermediate pinion 54.

If inversion wheel 72 pivots relative to intermediate pinion 54, clicks 62, 64 are raised because of the movement of the abutting end 80 of each resilient strip 68, 70 on the opposite side to the pivoting axis of the associated click 62, 64, strips 68, 70 no longer drawing clicks 62, 64 towards ratchet wheel 48.

The purpose of inversion wheel 72 is to facilitate maintenance operations for timepiece 10 by enabling clicks 50, 52 to be raised to let down spring 24, as will be explained hereinafter.

According to another advantageous feature of the invention, an auxiliary setting wheel 82 meshes with intermediate pinion 54. Auxiliary setting wheel 82 is drawn in rotation in the drive direction of strike train 16, i.e. in the direction of let down of barrel spring 24, so as to maintain a locking torque on intermediate pinion 54 during the winding phase of barrel spring 24.

The operation of timepiece 10 according to the invention will now be explained.

In a neutral situation, i.e. in the absence of striking or a winding operation, timepiece 10 indicates the current time and striking mechanism 18 is locked in a position ready to release a strike. Motion work 12 is driven in rotation by barrel gong 22 which is rotating here in the clockwise direction, via the effect of barrel spring 24, which is unwinding.

In this neutral situation, barrel spring 24 is unwinding in only one direction since, on the side of its first end 28, it is stationary, winding ratchet 38 being held in a fixed angular position by strike train 16 and striking mechanism 18.

During a striking phase, release member 19 releases striking mechanism 18, which releases strike train 16, which is driven in rotation by winding ratchet 38, which then rotates with barrel arbour 30, here in the anti-clockwise direction.

During the striking phase, barrel spring 24 unwinds via both ends since its first end 28 is connected in rotation to winding ratchet 38, whereas its second end 34 continues to move with barrel 22 to drive motion work 12 and to continue to display the current time.

During a winding phase, winding member 44 meshes with winding ratchet 38 to drive it in rotation, here in the clockwise direction, and thus to wind barrel spring 24.

The rotation of winding ratchet 38 causes intermediate wheel 46 to rotate, via main setting wheel 56, in the opposite direction relative to the striking phase, here in the clockwise direction. Ratchet wheel 48 rotates with intermediate wheel 46 causing clicks 50, 52 to rise, against resilient strips 68, 70, owing to its wolf teeth 49, such that intermediate pinion 54 remains substantially stationary angularly.

During the winding phase, auxiliary setting wheel 82 maintains a locking torque on intermediate pinion 54, which compensates for angular plays and thus, because of the release of the torque exerted by winding ratchet 38 on strike train 16 in the direction of release of the striking mechanism, prevents the elements of striking mechanism 18 from moving, which would be liable to cause an inadvertent release of the striking mechanism.

During a maintenance operation, it may be necessary to let barrel spring 24 down without having to release a series of strikes, particularly to relieve striking mechanism 18. By driving inversion wheel 72 in rotation relative to intermediate pinion 54, for example by means of a tool or a rack fitted to timepiece 10 and meshing with teeth of inversion wheel 72, in the anti-clockwise direction looking at FIG. 3, clicks 50, 52 are raised, which allows barrel spring 24 to be completed let down without driving striking mechanism 18 in rotation.

The present invention has been described here with reference to a timepiece 10 fitted with a grand strike mechanism. Of course, the invention applies to any timepiece comprising a strike train and a motion work, and wherein the energy for the striking mechanism is provided by a barrel, particularly timepieces having a striking mechanism with programmed release (alarm function) and small strike timepieces.

What is claimed is:

1. A timepiece including a motion work which drives analogue display means and a strike train which drives a striking mechanism, wherein the motion work is driven in rotation by a barrel including a barrel spring, a toothing which meshes with the motion work, and a winding ratchet coaxial to the barrel, the winding ratchet being secured in rotation to a drive arbour of the barrel, and wherein a winding member is provided to mesh with the winding ratchet in order to wind the barrel spring during a winding phase, wherein the winding ratchet drives the strike train in rotation via an intermediate wheel set whose axis is shifted relative to the axis of the barrel, and wherein the intermediate set includes a click device for uncoupling the winding ratchet relative to the strike train during the winding phase of the spring.

2. The timepiece according to claim 1, wherein the intermediate wheel set includes an intermediate wheel which is driven in rotation by the winding ratchet which is connected in rotation to the intermediate wheel, and an intermediate pinion which is connected in rotation to the ratchet wheel via at least one click and which meshes with the strike train.

3. The timepiece according to claim 2, wherein the intermediate wheel extends in the same plane as the winding ratchet.

4. The timepiece according to claim 2, wherein the ratchet wheel includes an axial extension and wherein the intermediate wheel is mounted to be secured in rotation to said axial extension.

5. The timepiece according to claim 2, wherein the ratchet wheel includes at least two clicks, and wherein the intermediate pinion is provided with a coaxial inversion wheel which is connected in rotation to the intermediate pinion with a determined angular clearance and which includes means for controlling the raising of the clicks when the inversion wheel is made to move angularly relative to the intermediate pinion.

6. The timepiece according to claim 2, wherein an auxiliary setting wheel meshes with the intermediate pinion and wherein the auxiliary setting wheel is secured in rotation in the drive direction of the strike train, so as to maintain a locking torque on the intermediate pinion during the winding phase.

7. The timepiece according to claim 1, wherein the winding ratchet meshes with a main setting wheel which meshes with the intermediate wheel set.

* * * * *

UNITED STATES PATENT AND TRADEMARK OFFICE

CERTIFICATE OF CORRECTION

PATENT NO. : 7,322,742 B2
APPLICATION NO. : 11/733884
DATED : January 29, 2008
INVENTOR(S) : Eric Goeller It is certified that error appears in the above-identified patent and that said Letters Patent is hereby corrected as shown below:

On Title Page item 30
Please insert the following Foreign Priority information:

-- April 12, 2006 (EP) ----------06112532.4 --

Signed and Sealed this

Thirteenth Day of May, 2008

JON W. DUDAS
*Director of the United States Patent and Trademark Office*